US005788536A

United States Patent [19]

Matsuura et al.

[11] Patent Number: 5,788,536

[45] Date of Patent: Aug. 4, 1998

[54] CONNECTOR HAVING ELONGATED PROTRUSIONS FOR SECURING A CONNECTING TERMINAL THEREIN

[75] Inventors: Toshifumi Matsuura; Yoshitsugu Sawada; Noboru Yamaguchi, all of Shizuoka, Japan

[73] Assignee: Yazaki Corporation, Tokyo, Japan

[21] Appl. No.: 925,658

[22] Filed: Sep. 9, 1997

Related U.S. Application Data

[63] Continuation of Ser. No. 672,048, Jun. 26, 1996.

[30] Foreign Application Priority Data

Jun. 26, 1995 [JP] Japan ..... 7-159398

[51] Int. Cl.[6] ..... H01R 13/40

[52] U.S. Cl. ..... 439/595; 439/746; 439/872; 439/752

[58] Field of Search ..... 439/595, 752, 439/752.5, 733.1, 872, 746, 374, 680

[56] References Cited

U.S. PATENT DOCUMENTS

| | | | |
|---|---|---|---|
| 3,332,053 | 7/1967 | Busler | 439/752 |
| 3,648,213 | 3/1972 | Kobler | 439/752 |
| 3,980,385 | 9/1976 | Hirokawa et al. | 439/752.5 |
| 4,955,827 | 9/1990 | Roy et al. | 439/595 |
| 5,226,839 | 7/1993 | Koumatsu et al. | 439/595 |
| 5,308,265 | 5/1994 | Kaneko | 439/595 |
| 5,350,292 | 9/1994 | Sanders et al. | 439/752.5 |
| 5,385,491 | 1/1995 | Fry | 439/752 |
| 5,468,162 | 11/1995 | Oda | 439/752 |
| 5,470,258 | 11/1995 | Suzuki et al. | 439/595 |

FOREIGN PATENT DOCUMENTS

| | | | |
|---|---|---|---|
| 1-92774 | 6/1989 | Japan | H01R 13/42 |
| 4-102576 | 9/1992 | Japan | H01R 13/42 |
| 4-105470 | 9/1992 | Japan | H01R 13/42 |

*Primary Examiner*—P. Austin Bradley
*Assistant Examiner*—Tho Dac Ta
*Attorney, Agent, or Firm*—Sughrue, Mion, Zinn, Macpeak & Seas, PLLC

[57] ABSTRACT

A connector in which the connecting terminal is prevented from shifting or playing, and the male and female terminals are positively engaged with each other. The connector comprises a plurality of elongated protrusions 20 formed on the walls of a terminal accommodating chamber 12 in such a manner that they extend in the direction of insertion of a female terminal 13. The female terminal includes a wire clamping section 18 comprising a conductor clamping portion 28 and a cover clamping portion 29. A locking protrusion 21 formed on the bottom of the cover clamping portion 29 is engaged with a locking groove 22 formed in the connector housing 11. Furthermore, the height of the cover clamping portion 29 is made substantially equal to the terminal accommodating chamber 12. Hence, both the position of the front end portion of the female terminal 13 and the position of the wire clamping section 18, which is the rear end portion of the terminal, are positively regulated. Therefore, even when a bending force or tensile force acts on the connected wire 19, the female terminal 13 will never be shifted or vibrated. Thus, with the connector of the invention, the female terminal 13 is positively engaged with the mating male terminal.

8 Claims, 7 Drawing Sheets

CONNECTOR HAVING ELONGATED PROTRUSIONS FOR SECURING A CONNECTING TERMINAL THEREIN

This is a Continuation of application No. 08/672,048 filed Jun. 26, 1996, abandoned.

BACKGROUND OF THE INVENTION

1. Field of the Industrial Application

This invention relates to an electrical connector suitable for automobiles, and more particularly to an electrical connector in which the shifting or playing of a connecting terminal is prevented which is due to the gaps between the connector housing and the connecting terminal, and the insufficient engagement of the male terminal with the female terminal is also prevented.

2. Description of the Prior Art

A connector for wiring an automobile has been disclosed, for instance, by Japanese Utility Patent Application (OPI) No. 102576/1992 (the term "OPI" as used herein means an "unexamined publication application"). As shown in FIG. 9, in a connector 5, a female terminal 53 is inserted into a terminal accommodating chamber 52 of a connector housing 51.

The female terminal 53 has a wire clamping section to which an electrical wire is connected. An elastic locking piece 54 is formed on the bottom of the connector housing 51. A space suitable in size is formed below the locking piece 54. The space thus formed is means for relieving the locking piece 54 (hereinafter referred to as "a relieving section 56", when applicable). A terminal inserting opening 55 for inserting a male terminal (not shown) is formed in the front end of the connector housing.

The elastic locking piece 54 has a locking protrusion 57, which is engaged with a locking hole 58 formed in the female terminal 53. This feature prevents the female terminal 53 from coming off the connector housing 51 for instance when the wire is pulled.

A terminal pressing piece 59 is pushed into the relieving section 56 provided below the elastic locking piece 54. The terminal pressing piece 59 has a stopper 60 which is abutted against the elastic locking piece 54. The latter 54 is pushed upwardly by the terminal pressing piece 59, and accordingly the female terminal 53 is pushed against the ceiling (upper surface) of the connector housing.

As a result, no gap is formed between the connector housing 51 and the female terminal 53, which prevents the female terminal from shifting or playing, and prevents the insufficient contact of the female terminal 53 and the male terminal.

As was described above, in the conventional connector, the terminal pressing piece 59 is inserted into the front end side of the female terminal 53. Hence, as viewed in the vertical direction of the female terminal and the connector housing (in the vertical direction in FIG. 9) no gap is formed between the female terminal 53 and one inner surface of the terminal accommodating chamber 52; however, other gaps still remain. That is, a gap remains between the female terminal 53 and the other inner surface of the terminal accommodating chamber 52 on the side of the elastic locking piece 54, and a gap remains between the rear end portion of the female terminal 53 and the wire.

Hence, as shown in FIG. 10, when a bending force acts on the connected wire 61 laterally, the female terminal 53 is shifted.

When a bending force acts on the connected wire 61 vertically, the female connector 53 is shifted vertically with the locking end 62 of the elastic locking piece as a fulcrum.

Furthermore, when a bending force or tensile force acts on the connected wire 61 laterally as shown in FIG. 12 or vertically as shown in FIG. 13, the middle portion 63 of the female terminal 53 may be deformed.

If the female terminal 53 is shifted or deformed as was described above, then the female terminal and the male terminal may be insufficiently contacted with each other, which may result in various troubles.

SUMMARY OF THE INVENTION

Accordingly, an object of the invention is to eliminate the above-described difficulties accompanying a conventional connector. More specifically, an object of the invention is to provide a connector in which the connecting terminal is prevented from shifting or playing, and the male and female terminals are positively connected to each other.

The foregoing object of the invention has been achieved by the provision of the following means:

The first means is a connector in which an elastic locking piece of a connector housing locks a connecting terminal accommodated in the connector housing, in which, according to one aspect of the invention, a plurality of elongated protrusions are formed on the walls of a terminal accommodating chamber in the connector housing in such a manner that the elongated protrusions are extended in the direction of insertion of the connecting terminal.

In the first means, the plurality of elongated protrusions are substantially semi-circular in cross-section.

The second means is a connector in which an elastic locking piece of a connector housing locks a connecting terminal accommodated in the connector housing, in which, according to another aspect of the invention, a locking protrusion is formed on the bottom surface of a wire clamping portion of the connecting terminal, and a locking groove is formed in the inner surface of the connector housing which is engaged with the locking protrusion.

In the second means, the height of a cover clamping portion of the wire clamping section is determined in correspondence to the height of the terminal accommodating chamber so as to minimize the gaps between the cover clamping portion and the walls of the terminal accommodating chamber.

The third means is a connector in which an elastic locking piece of a connector housing locks a connecting terminal accommodated in the connector housing, in which, according to still another aspect of the invention, a position regulating member for regulating the position of the connecting terminal is provided as an individual component separated from the connector housing and the connecting terminal.

In the third means, the position regulating member comprises: a flat-plate-shaped base; a pair of protruded pieces extending from the lower surface of the base; and a pair of holding pieces which are located behind the pair of protruded pieces and which extend from the lower surface of the base.

In the connector of the first means, the elongated protrusions are formed on the walls of the terminal accommodating chamber in the connector housing in such a manner that they extend in the direction of insertion of the connecting terminal.

Hence, when the connecting terminal is inserted into the terminal accommodating chamber, it abuts against the elongated protrusions. Therefore, even if a bending force acts on the connected wire in all directions, the connecting terminal is prevented from being shifted or vibrated inside the terminal accommodating chamber.

Since the elongated protrusions are substantially semi-circular in cross-section, the contact area of the connecting terminal with the elongated protrusions is small. Therefore, the connecting terminal can be inserted into the terminal accommodating chamber smoothly and readily.

In the connector of the second means, the locking protrusion is formed on the bottom of the wire clamping section of the connector terminal, while the locking groove is formed in the inner surface of the connector housing so as to be engaged with the locking protrusion.

Hence, when the connecting terminal is inserted into the terminal accommodating chamber, the locking protrusion is engaged with the locking groove. Therefore, even if a bending force act on the connected wire laterally, the terminal will never be shifted or vibrated in the terminal accommodating chamber.

Furthermore, the height of the cover clamping portion of the wire clamping section of the connecting terminal corresponds to the internal height of the terminal accommodating chamber in such a manner as to minimize the gaps between the cover clamping portion and the walls of the terminal accommodating chamber. Hence, even when a bending force acts on the connecting terminal longitudinally thereof, the terminal will never be shifted or vibrated in the terminal accommodating chamber.

In the connector of the third means, the position regulating member for regulating the position of the connecting terminal is provided as a component separated from the connector housing and the connecting terminal.

The position regulating member comprises the flat-plate-shaped base, the pair of protruded pieces extending downwardly from the lower surface of the base, and the pair of holding pieces which are located behind the protruded pieces and extended downwardly from the lower surface of the base.

Hence, inside the terminal accommodating chamber, the conductor clamping portion of the connecting terminal is held by the pair of holding pieces from both sides, while the pair of protruded pieces lock the front end portion of the connecting terminal and detect whether or not the connecting terminal has been sufficiently inserted into the terminal accommodating chamber. Hence, even if a bending force acts on the connected wire in all directions, the conductor clamping portion will never be shifted nor vibrated.

DETAILED DESCRIPTION OF THE PREFERRED EMBODIMENTS

Preferred embodiments of the invention will be described with reference to FIGS. 1 through 8 in detail.

Figure 1:
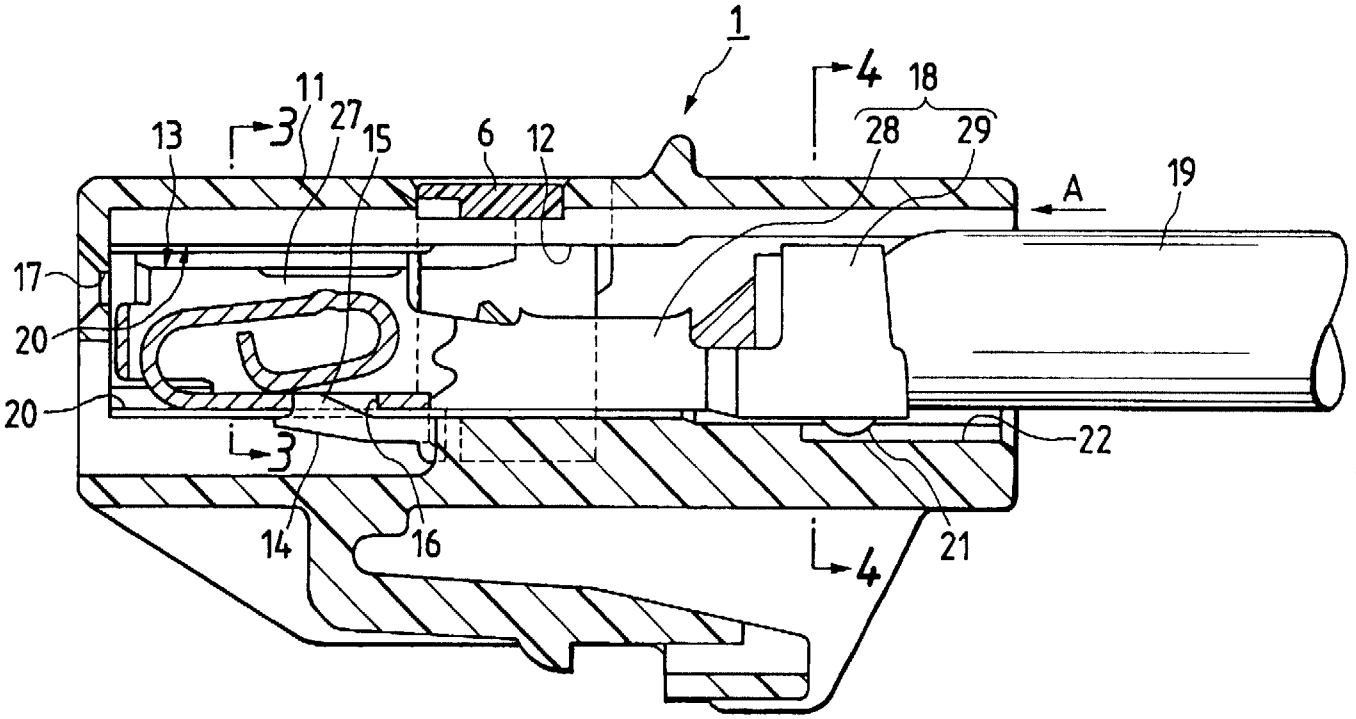
FIG. 1 is a sectional view of an example of a connector, which constitutes a first embodiment of the invention.

In FIG. 1, reference numeral 1 designates the connector, the first embodiment of the invention. In the connector 1, a female terminal 13 is inserted in a terminal accommodating chamber 12 which is formed by a connector housing 11. An elastic locking piece 14 is formed on the bottom of the connector housing 11. A locking protrusion 15 is formed on the upper surface of the elastic locking piece 14. A locking hole 16 is formed in the bottom of the female terminal 13. The locking hole 16 thus formed is engaged with the locking protrusion 15 of the elastic locking piece 14 so as to prevent the female terminal 13 from coming off the connector housing unintentionally.

The female terminal 13 includes a conductor clamping portion 28, over which a retainer 6 is provided. The retainer 6 is to lock the rear end of the electrical connecting section 27 of the female terminal 13, and to detect the insufficient insertion of the female terminal.

An inserting hole 17 is formed in the front end of the connector housing 11 through which a male terminal (not shown) is inserted so as to be engaged with the female terminal. The rear end portion of the female terminal 13 is formed into a wire clamping section 18 which comprises the aforementioned conductor clamping portion 28 and a cover clamping portion 29. The latter 29 is folded over the end portion of an electrical wire 19 to fixedly clamp the latter. That is, the female terminal is connected to the electrical wire 19 with the aid of the rear end portion thereof (see FIG. 7).

Figure 2:
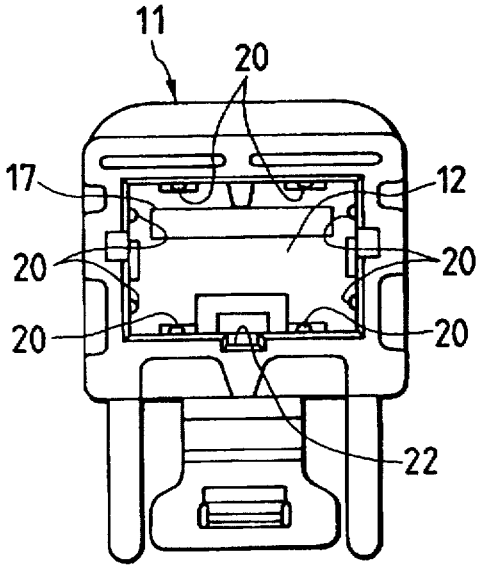
FIG. 2 is a diagram as viewed in the direction of the arrow A in FIG. 1.
Figure 3:
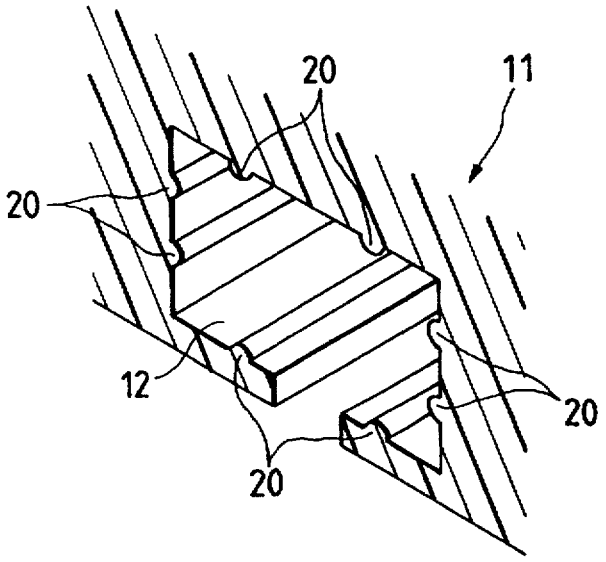
FIG. 3 is a sectional view taken along line 3—3 in FIG. 1.

As shown in FIGS. 2 and 3, a plurality of elongated protrusions (stripes) 20 are formed on the walls of the terminal accommodating chamber 12 which is defined by the connector housing 11 in such a manner that they are extended in the direction of insertion of the terminal so that they abut against the outer cylindrical surface of the female terminal 13. More specifically, at least one elongated protrusion 20 is formed on each of the walls of the terminal accommodating chamber in the connector housing. In the first embodiment, two elongated protrusions 20 are symmetrically arranged on each of the walls of the terminal accommodating chamber in the connector housing. The elongated protrusions 20 are each substantially semi-circular in cross-section.

Hence, the outer surface of the front end portion of the female terminal 13 which is brought into contact with the mating terminal is regulated in position inside the terminal accommodating chamber 12 of the connector housing 11, which positively prevents the front end portion of the female terminal 13 from being shifted or vibrated. Since the elongated protrusions 20 are substantially semi-circular in section as was described above, the contact of the female terminal 13 with the elongated protrusions is small in area, which makes it possible to smoothly and readily insert the terminal into the terminal accommodating chamber.

Figure 4:
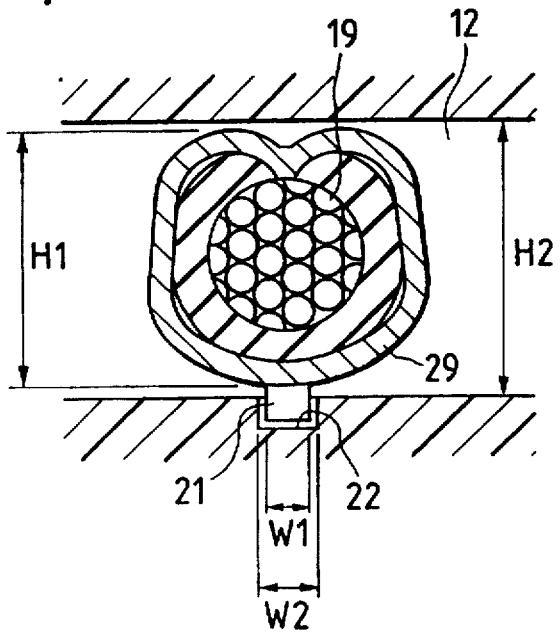
FIG. 4 is also a sectional view taken along line 4—4 in FIG. 1.

As shown in FIGS. 1 and 4, a locking protrusion 21 is formed on the bottom of the cover clamping portion 29 of the female terminal 13. On the other hand, a locking groove 22 is formed in the bottom (the inner surface) of the terminal accommodating chamber 12 of the connector housing 11 so as to lock (or engage with) the locking protrusions. Hence, when the female terminal 13 is inserted into the terminal accommodating chamber 12, the locking protrusion 21 is engaged with the locking groove 22, so that the wire clamping section 18, which is the rear end portion of the female terminal 13, can be positively prevented from being shifted laterally.

In this connection, as shown in FIG. 4, the difference between the width W1 of the locking protrusion 21 and the width W2 of the locking groove 22 is made as small as possible; that is, the clearance between the locking protrusion 21 and the locking groove 22 is minimized.

Furthermore, as shown in FIG. 4, the height H1 of the cover clamping portion 29 of the female terminal is substantially equal to the height H2 of the terminal accommodating chamber 12 in the connector housing 11. Hence, the cover clamping portion 29 is abutted against the upper and lower walls of the terminal accommodating chamber 12. That is, no vertical clearance is provided between the cover clamping portion 29 and the terminal accommodating chamber 12, which positively prevents the female terminal from being vertically shifted in the terminal accommodating chamber.

As was described above, in the connector 1 of the invention, the position of the front end portion of the female terminal in the terminal accommodating chamber 12 is regulated by the elongated protrusions 20 of the connector housing 11. On the other hand, the position of the rear end portion of the female terminal 13 is regulated by the engagement of the locking protrusion 21 of the cover clamping portion 29 with the locking groove 22 of the connector housing 11, and by the fact that the height of the cover clamping portion 29 is substantially equal to the height of the terminal accommodating chamber.

Hence, even when a bending force or tensile force acts on the connected wire 19 laterally or longitudinally, the female terminal 13 will never be shifted or vibrated inside the terminal accommodating chamber 12, and the female terminal 13 is positively prevented from being deformed for instance.

A second embodiment of the invention in which the position regulating means of the female terminal is different from that which has been described above, will be described with reference to FIG. 5. As is seen from comparison of FIG. 5 with FIG. 1, the second embodiment is different from the first embodiment in that a position regulating means, is utilized to regulate the position of the wire clamping section 38.

In the connector 3, similarly as in the above-described connector 1, a female terminal 33 is inserted into a terminal accommodating chamber 32 in the connector housing 31. An elastic locking piece 34 is formed on the bottom of the terminal accommodating chamber 32. A locking protrusion 35 is formed on the upper surface of the elastic locking piece. The locking protrusion 35 thus formed is engaged with a locking hole 36 which is formed in the bottom of the female terminal 33. An inserting hole 37 is formed in the front end of the connector housing 31 into which the mating male terminal is inserted. The rear end portion of the female terminal is formed into a wire clamping section 38 which is folded over the end portion of an electrical wire 39 to fixedly clamp the latter.

Figure 7:
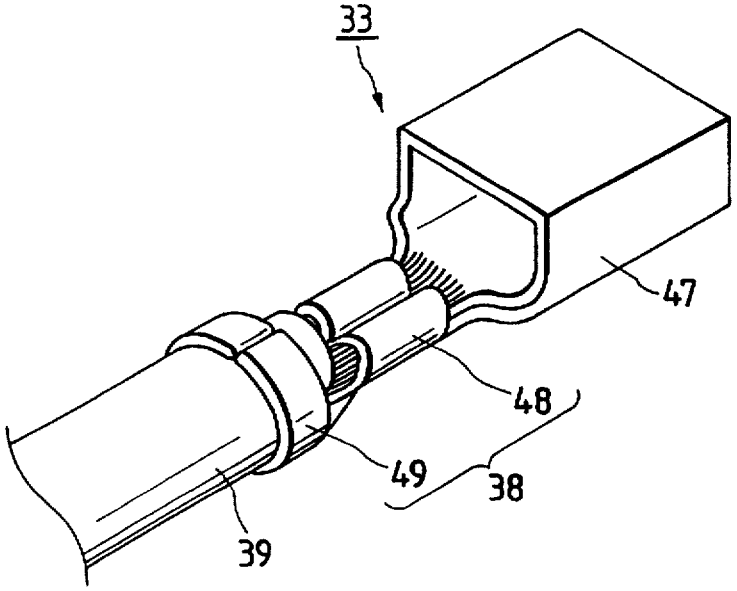
FIG. 7 is a perspective view of a female terminal.

As shown in FIG. 7, the wire clamping section 38 of the female terminal 33, similarly as in the case of the female terminal 13 described above, comprises: a conductor clamping portion 48 adapted to clamp the conductors of the end portion of the electrical wire 39 which has been uncovered; and a cover clamping portion 49 adapted to clamp the wire 39 through the cover. The front end portion of the female terminal 33 has an electrical connecting section 47 which is connected to the mating terminal.

Similarly as in the case of the above-described connector 1, elongated protrusions are formed on the inner surfaces of the walls of the terminal accommodating chamber 32 in the connector housing in such a manner that they are extended in the direction of insertion of the female terminal 33, to regulate the position of the front end portion of the female terminal. In addition, the height of the cover clamping portion 49 is made substantially equal to the height of the terminal accommodating chamber 32 of the connector housing 31, to regulate the position of the rear end portion of the female terminal 33.

Figure 5:
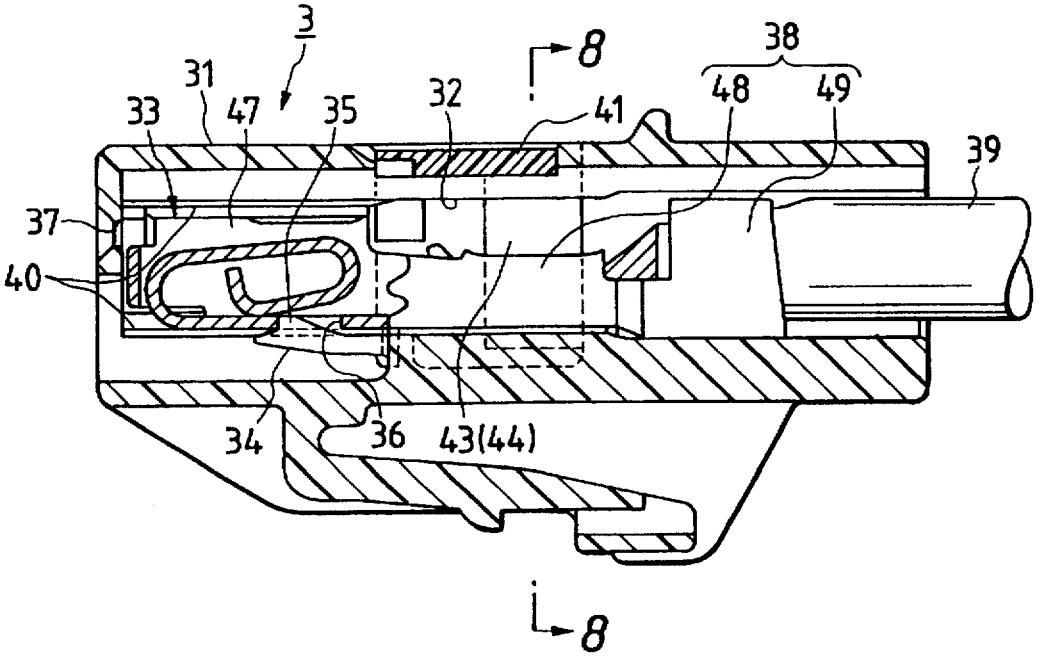
FIG. 5 is a sectional view of another example of the connector, which constitutes a second embodiment of the invention.
Figure 6:
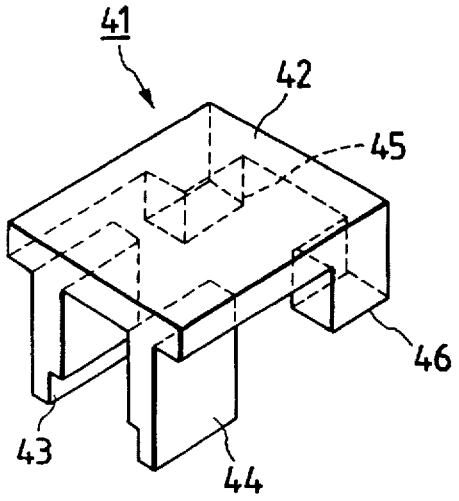
FIG. 6 is a perspective view of a retainer.

As shown in FIG. 5, the aforementioned retainer 41 is arranged at the conductor clamping portion 48 which is the rear end portion of the female terminal 33. The retainer 41, as shown in FIG. 6, comprises a pair of protruded pieces 45 and 46 which are extended from the lower surface of a flat-plate-shaped base 42. The protruded pieces 45 and 46 are to lock the rear end of the electrical connecting section 47 of the female terminal 33, and to detect the insufficient insertion of the terminal. The retainer 41 further comprises a pair of holding pieces 43 and 44 extended from the base 42 in such a manner that they are located respectively behind the protruded pieces 45 and 46 and are suitably spaced from each other so that they hold the conductor clamping portion 48 from both sides.

Figure 8:
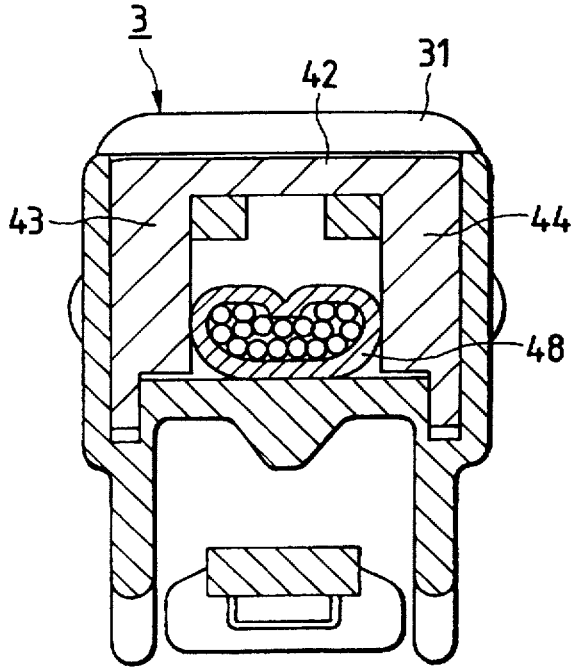
FIG. 8 is a sectional view taken along 8—8 in FIG. 5.
Figure 9:
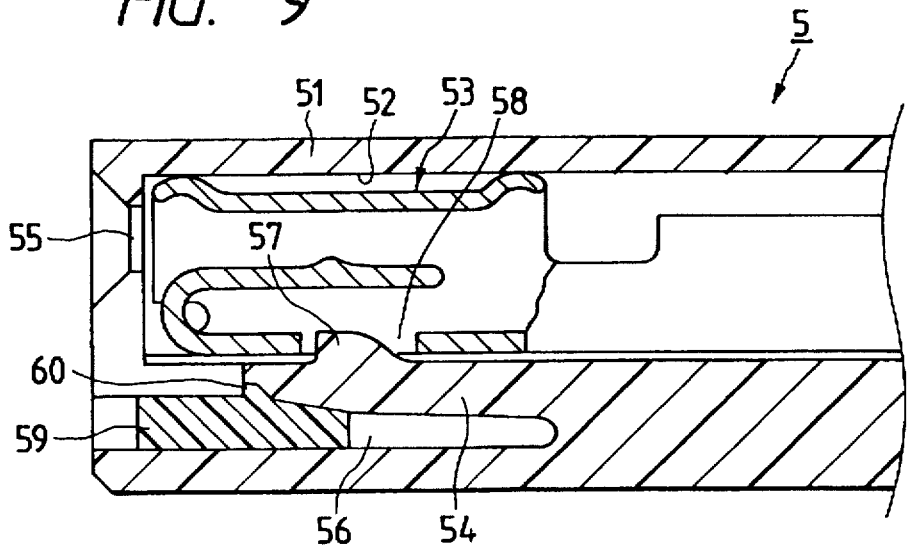
FIG. 9 is a sectional view of a conventional connector.
Figure 10:
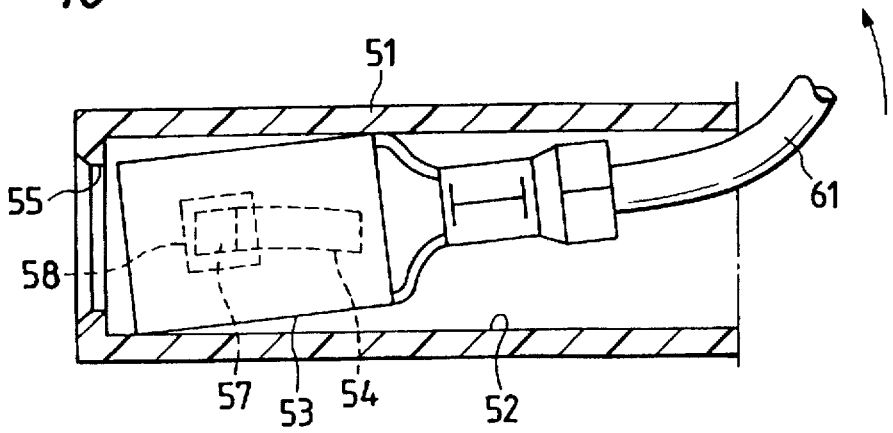
FIG. 10 is an explanatory diagram for a description of the positional shift of a conventional connecting terminal in the lateral direction.
Figure 11:
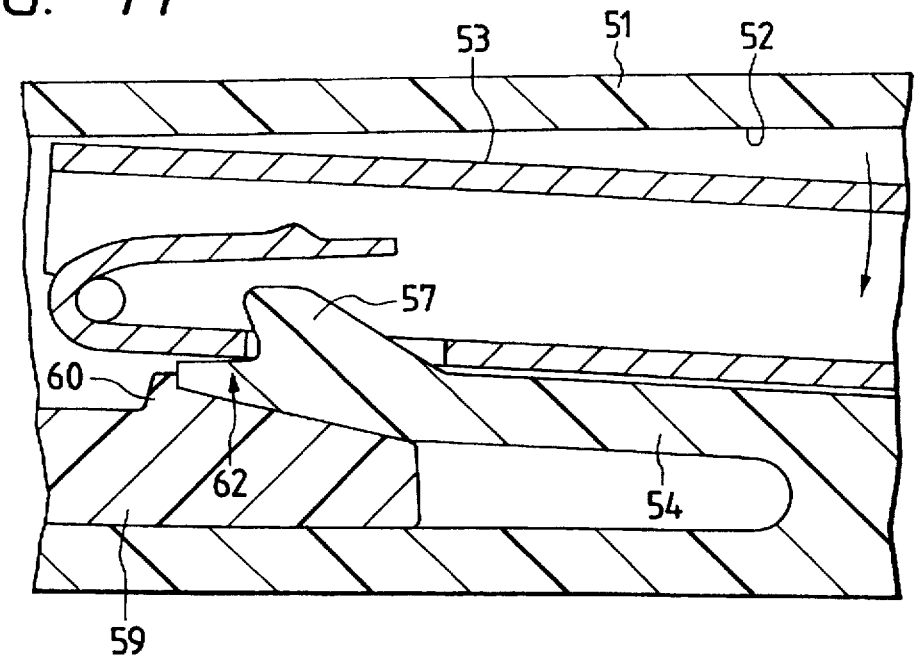
FIG. 11 is an explanatory diagram for a description of the positional shift of the conventional connecting terminal in the longitudinal direction.
Figure 12:
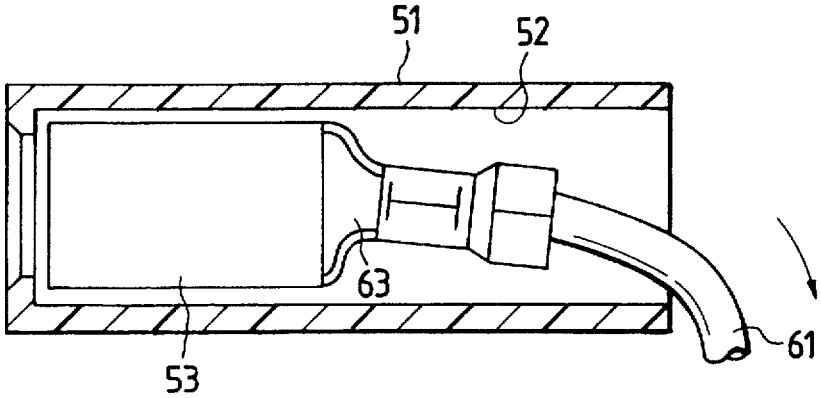
FIG. 12 is an explanatory diagram for a description of the deformation of the conventional connecting terminal in the lateral direction.
Figure 13:
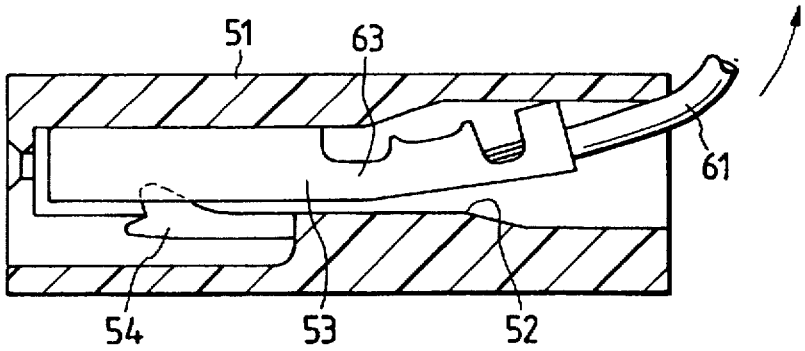
FIG. 13 is an explanatory diagram for a description of the deformation of the conventional connecting terminal in the longitudinal direction.

As shown in FIG. 8, the holding pieces 43 and 44 of the retainer 41 are set on both sides of the conductor clamping portion 48 to hold the latter 48, thus preventing the conductor clamping portion 48 from being shifted laterally. That is, the retainer 41 set in the above-described manner, eliminates the clearances between the connector housing 31 and both side surfaces of the conductor clamping portion 48, so that the position of the conductor clamping portion 48 is regulated in the lateral direction.

As was described above, the position of the front end portion and the rear end portion of the electrical connecting section 47 of the female terminal 33 is regulated by the elongated protrusions 40 and the protruded pieces 45 and 46 of the retainer, respectively, and the position of the wire clamping section 38 of the female terminal 33 is regulated by the holding pieces 43 and 44 of the retainer and by the height of the cover clamping portion 49 which is made substantially equal to the height of the terminal accommodating chamber 32. Hence, even when a bending force or tensile force acts on the connected wire 39 laterally or longitudinally, the female terminal 33 will never be shifted or vibrated inside the terminal accommodating chamber 32, and the female terminal 33 is positively prevented from being deformed for instance. In addition, the problem of the female terminal 33 not sufficiently contacting the mating male terminal is eliminated.

While the invention has been described in connection with the preferred embodiment of the invention, the invention is not limited thereto or thereby, and it will be obvious to those skilled in the art that various changes and modifications may be made therein without departing from the invention. For instance, although, in the second embodiment, the retainer has a pair of protruded pieces, the retainer will work satisfactorily if it has only one protruded piece. Furthermore, the above-described embodiments are directed to female connectors; however, it goes without saying that the technical concept of the invention is applicable to male connectors.

The above-described connectors of the invention has following noticeable effects or merits:

In the connector of the first embodiment, a plurality of elongated protrusions are formed on the walls of the terminal accommodating chamber in the connector housing in such a manner that they are extended in the direction of insertion of the connecting terminal, and the elongated protrusions are substantially semi-circular in section.

Hence, when the connecting terminal is inserted into the terminal accommodating chamber, it abuts against the elongated protrusions. Therefore, even if a bending force acts on the connected wire in all directions, the connecting terminal is prevented from being shifted or vibrated inside the terminal accommodating chamber.

Furthermore, the contact area of the connecting terminal with the elongated protrusions is small. Therefore, the connecting terminal can be inserted into the terminal accommodating chamber smoothly and readily.

Also, in the connector of the first embodiment, a locking protrusion is formed on the bottom of the cover clamping portion of the connector terminal, and the locking groove is formed in the inner surface of the connector housing so as to be engaged with the locking protrusion. Furthermore, the height of the cover clamping portion of the wire clamping section of the connecting terminal is substantially equal to the internal height of the terminal accommodating chamber so as to minimize the clearances between the cover clamping portion and the walls of the terminal accommodating chamber.

Hence, when the connecting terminal is inserted into the terminal accommodating chamber, the locking protrusion is engaged with the locking groove. Therefore, even if a lateral bending force acts on the connected wire laterally, the terminal will never be shifted or vibrated in the terminal accommodating chamber.

Furthermore, even when a bending force acts on the connecting terminal longitudinally thereof, the terminal will never be shifted or vibrated in the terminal accommodating chamber, because the height of the cover clamping portion is substantially equal to the internal height of the terminal accommodating chamber.

In the connector of the second embodiment, a position regulating member for regulating the position of the connecting terminal is provided as a component separate from the connector housing and the connecting terminal.

In addition, the position regulating member comprises a flat-plate-shaped base, a pair of protruded pieces extending downwardly from the lower surface of the base, and a pair of holding pieces which are located behind the protruded pieces and extended downwardly from the lower surface of the base.

Hence, inside the terminal accommodating chamber, the conductor clamping portion of the connecting terminal is held by the pair of holding pieces from both sides, and the pair of protruded pieces locks the front end portion of the connecting terminal and are able to detect whether or not the connecting terminal has been sufficiently inserted into the terminal accommodating chamber. Hence, even if a bending force or tensile force acts on the connected wire in all directions, the connecting terminal will never be shifted nor vibrated.

As was described above, in the connector of the invention, the connecting terminal is positively prevented from being shifted or vibrated in the terminal accommodating chamber. Furthermore, the female terminal in the terminal accommodating chamber can be positively engaged with the mating male terminal at all times. Thus, the connector of the invention is highly reliable.

What is claimed is:

1. A connector in which an elastic locking piece of a connector housing locks a connecting terminal accommodated in said connector housing, comprising:

a position regulating member for regulating position of said connecting terminal provided as a component separate from said connector housing and said connecting terminal, wherein said position regulating member comprises a flat-shaped base;

a pair of protruding pieces extending downwardly from a lower surface of said base and engaging a rear end portion of the connecting terminal; and a pair of holding pieces which are located behind said pair of protruding pieces and which extend downwardly from the lower surface of said base and engage a wire clamping section of the connecting terminal, wherein said holding pieces eliminate the clearance between the connector housing and side surfaces of a conductor clamping portion to restrict lateral movement of said connecting terminal.

2. A connector of claim 1, wherein said position regulating means further comprises:

wherein said protruding pieces restrain movement of the rear end portion of said connecting terminal.

3. A connector in which an elastic locking piece of a connector housing locks a connecting terminal accommodated in said connector housing, further comprising a position regulating member for regulating position of said connecting terminal provided as a component separate from said connector housing and said connecting terminal, wherein said position regulating member comprises:

a flat-plate-shaped base;

a pair of protruding pieces extending downwardly from a lower surface of said base and engaging a rear end portion of the connecting terminal; and a pair of holding pieces which are located behind said pair of protruded pieces and which extend downwardly from the lower surface of said base and engage a wire clamping section of the connecting terminal.

4. The connector according to claim 3, further comprising:

a plurality of elongated protrusions formed on interior walls of a terminal accommodating chamber in said connector housing in such a manner that said elongated protrusions extend in direction of insertion of said connecting terminal, wherein said plurality of elongated protrusions are substantially semi-circular in cross-section.

5. A connector as claimed in claim 3, wherein said protruded pieces lock said connecting terminal, and said holding pieces hold a conductor clamping portion of said connecting terminal to prevent sideway motion.

6. A connector comprising:

a connector housing having an elastic locking piece a connecting terminal accommodated in said connector housing;

a wire clamping section of said connecting terminal having a cover clamping part and a conductor clamping part, and a locking protrusion formed on the bottom surface of the cover clamping part of the wire clamping section of said connecting terminal, wherein the inner surface of said connector housing includes a locking groove which is engaged with said locking protrusion.

7. The connector according to claim 6, wherein:

said conductor clamping portion is disposed between a front end of said connecting terminal and the cover clamping portion, wherein said conductor clamping portion is adapted to clamp conductors of the uncovered portion of the electrical wire, and said cover clamping portion is adapted to clamp the wire through the cover, wherein the height of said cover clamping portion is substantially equal to the height of a terminal accommodating chamber in said connector housing so as to minimize the clearances between said cover clamping portion and the walls of said terminal accommodating chamber.

8. A connector as claimed in claim 6, wherein width of said locking protrusion is substantially equal to width of said locking groove.

* * * * *